United States Patent [19]

Eheim et al.

[11] Patent Number: 4,483,297

[45] Date of Patent: Nov. 20, 1984

[54] FUEL INJECTION PUMP FOR INTERNAL COMBUSTION ENGINES

[75] Inventors: Franz Eheim, Stuttgart; Gerald Höfer, Weissach; Claus Köster, Ditzingen; Karl Konrath, Ludwigsburg; Manfred Schwarz, Gerlingen, all of Fed. Rep. of Germany

[73] Assignee: Robert Bosch, Stuttgart, Fed. Rep. of Germany

[21] Appl. No.: 410,670

[22] Filed: Aug. 23, 1982

[30] Foreign Application Priority Data

Sep. 8, 1981 [DE] Fed. Rep. of Germany ..... 3135477

[51] Int. Cl.[3] ..... F02D 1/04; F02M 59/24

[52] U.S. Cl. ..... 123/449; 123/387; 123/503; 417/294

[58] Field of Search ..... 123/449, 387, 503, 502, 123/373, 365, 179 L; 417/294, 282, 284

[56] References Cited

U.S. PATENT DOCUMENTS

| | | | |
|---|---|---|---|
| 3,946,713 | 3/1976 | Laufer | 123/387 |
| 4,168,690 | 9/1979 | Hofer | 123/502 |
| 4,342,301 | 8/1982 | Tomita | 123/502 |
| 4,397,280 | 8/1983 | Yasuhara | 123/449 |
| 4,418,667 | 12/1983 | Djordjeuic | 417/294 |

FOREIGN PATENT DOCUMENTS

| | | | |
|---|---|---|---|
| 2812176 | 9/1979 | Fed. Rep. of Germany | 123/502 |
| 2813111 | 9/1979 | Fed. Rep. of Germany | 123/503 |

*Primary Examiner*—Charles J. Myhre
*Assistant Examiner*—Carl Stuart Miller
*Attorney, Agent, or Firm*—Edwin E. Greigg

[57] ABSTRACT

A fuel injection pump is proposed, which has a centrifugal governor disposed in the suction chamber of the fuel injection pump, the governor having a sleeve displaceable on a piston, and a pressure chamber enclosed in the interior of the governor sleeve, the latter being defined by the end face of the piston. By means of a relief line of the pressure chamber which is opened in the offset position of the governor sleeve, the restoring force on the centrifugal governor is increased during starting by the amount of the pressure difference appearing at the governor sleeve. Beyond a predetermined adjustment of the governor sleeve, the relief line is blocked, so that the governor can function unhindered within the normal operational range. The hysteresis thus resulting upon the shut-off of the increased starting quantity improves the behavior of the engine as it runs up to operational speed.

13 Claims, 6 Drawing Figures

FUEL INJECTION PUMP FOR INTERNAL COMBUSTION ENGINES

BACKGROUND OF THE INVENTION

The invention is based on a fuel injection pump as revealed hereinafter. In an injection pump of this kind, such as that known from German Offenlegungsschrift No. 24 03 082.8, a starting lever is actuated by the governor sleeve and can be coupled via a starting spring with an adjusting lever, and the quantity adjusting member of the fuel injection pump is articulated onto this starting lever. After the starting lever has come to rest on the adjusting lever, the governor sleeve functions counter to the force of an adjustable governor spring and controls the quantity of fuel to be injected, the quantity being effected via the fuel quantity adjusting member. The chamber enclosed between the governor sleeve and the piston communicates with the fuel-filled suction chamber of the fuel injection pump, so that the governor sleeve is easily displaceable.

In the known fuel injection pump, an increased starting quantity is established with this apparatus at the outset position of the governor sleeve. Depending on the design of the starting spring, this increased starting quantity is eliminated shortly before the idling rpm is attained, in that the governor sleeve causes the starting lever to come to rest on the adjusting lever. However, in some engines, interruption of the smooth, jerk-free operation of the engine occurs at the transition from the starting enrichment to idling operation.

OBJECT AND SUMMARY OF THE INVENTION

The fuel injection pump has the advantage over the prior art that the elimination of the increased starting quantity does not take place at a lower rpm than the idling rpm, but instead is effected only at a higher rpm. Thus the transition between the starting phase and idling operation can be substantially improved. On the other hand, an increased fuel quantity, that is, the increased starting quantity, is prevented from being supplied to the engine when the rpm is dropping during idling operation. The reestablishment of the increased starting quantity is effected according to the invention only when a relatively low rpm has once again been attained, so that over the entire load/rpm operation of the engine, an exessively increased fuel quantity is not injected.

Advantageous further embodiments and improvements to the apparatus disclosed in the main claim are attainable by means of the characteristics disclosed in the dependent claims.

The invention wil be better understood and further objects and advantages thereof will become more apparent from the ensuing detailed description of four preferred embodiments taken in conjunction with the drawings.

DESCRIPTION OF A PREFERRED EMBODIMENT

Figure 1:
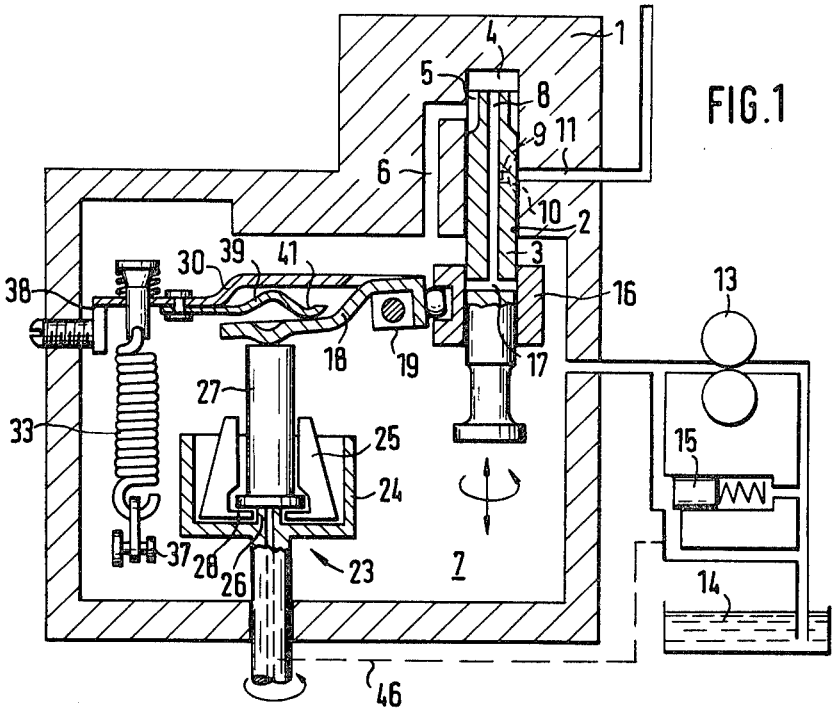
FIG. 1 shows a cross sectional view of a fuel injection pump having a centrifugal governor, which acts upon a starting lever of a quantity adjusting device.

A pump piston 3 simultaneously reciprocates and rotates within a cylinder 2 of a housing 1 of a fuel injection pump. The pump work chamber 4 of this pump is supplied with fuel from a suction chamber 7 via longitudinal grooves 5 disposed in the jacket face of the pump piston and via a conduit 6 extending within the housing 1, as long as the pump piston is executing its intake stroke or has assumed its bottom dead center position. As soon as the conduit 6 is closed upon the beginning of the compression stroke and following a corresponding rotation by the pump piston, the fuel located in the pump work chamber 4 is pumped into a longitudinal conduit 8 extending in the pump piston. From the longitudinal conduit 8, the fuel is carried further via a branching radial bore 9 and a distributor groove 10 disposed in the surface of the pump piston to one of pressure lines 11 which are appropriately distributed about the circumference of the cylinder bore 2 and which correspond in number to the number of engine cylinders to be supplied with fuel; these pressure lines 11 lead to the injection valves (not shown) of the individual cylinders of the engine.

The suction chamber 7 is supplied with fuel via a supply pump 13 from a fuel supply container 14. The pressure in the suction chamber is controlled in accordance with rpm in a known manner by means of a pressure control valve 15 parallel to the fuel supply pump 13.

Acting as the quantity adjusting member, an annular slide 16 is displaceable on the pump piston 3 and opens a radial bore 17 communicating with the longitudinal conduit 8 during the course of the compression stroke of the pump piston 3, thus determining the end of fuel supply or determining the quantity of fuel supplied by the pump piston to the pressure lines 11. The fuel flowing out after this radial bore 17 has been opened flows back into the suction chamber 7.

The annular slide element 16 is displaced via a starting lever 18, which is pivotable about a shaft 19 inserted firmly into the housing and is coupled at one end with the annular slide element 16. An rpm governor embodied as a centrifugal governor 23 and disposed in the suction chamber engages the other arm of the intermediate lever 18. The centrifugal governor 23, which is driven by a gear mechanism (not shown) in accordance with the pump piston rpm, has a rotating carrier 24 on which flyweights 25 are disposed. Coaxially with the axis of the carrier 24, the carrier has a piston 26, on which a sleeve 27 is disposed such that it is tightly displaceable. The sleeve 27 is closed at one end, and in its inner bore 29, together with the end face 31 of the piston, it encloses a pressure chamber 32. The lowermost end of the sleeve 27 is engaged by nose-like parts 28 of the flyweights 25, so that upon the deflection of the flyweights 25, the sleeve is displaced by the flyweights axially on the piston 26, and itself simultaneously displaces the starting lever 18 and the annular slide element 16.

A one-armed adjusting lever 30 is pivotably disposed on the same shaft 19, independently of the starting lever 18. A governor spring arrangement 33 is articulated to the end of this adjusting lever 30, and on the other end the governor spring arrangement 33 is suspended on an arbitrarily adjustable lever 37. An adjustable full-load stop 38 for the adjusting lever 30 is also provided.

A leaf spring 39 secured with its outer end to the adjusting lever 30 protrudes into the interstice between the adjusting lever 30 and the starting lever 18. The leaf spring is bent approximately at its middle toward the centrifugal adjuster 23 and rests on the starting lever 18. The leaf spring 39 tends to cause the two levers to spread apart.

The injection quantity regulation of the previously described injection pump according to FIG. 1 functions as follows:

Depending upon the position of the annular slide element 16, the radial bore 17 and thus the relieving communication from the work chamber 4 to the pump suction chamber 7 is opened earlier or later during the compression stroke or supply stroke of the pump piston 3, and the fuel supply into the pressure lines 11 is thus interrupted. In the topmost position of the annular slide element 16, the maximum or the entire fuel quantity supplied by the pump piston 3 is thus delivered to the pressure lines 11. The farther the annular slide element 16 is displaced toward the bottom, the earlier the radical bore 17 will be opened and the earlier supply will be interrupted. In the illustrated starting position shown in FIG. 1, the adjusting lever 30 rests on the full-load stop 38, while the starting lever 18 is pressed by the leaf spring 39 against the sleeve 27 of the centrifugal adjuster 23. As a result of the deflection of the starting lever 18, the annular slide element 16 is simultaneously moved into its uppermost position, corresponding to the supply of an excess fuel quantity. After starting of the engine, the flyweights 25 are deflected outward by the increasing rpm, so that the sleeve 27 is displaced upward, and with increasing rpm the sleeve 27 pivots the starting lever 18 counter to the force of the leaf spring 39 until it comes to rest on the adjusting lever 30. At this instant, the excess fuel quantity is reduced to the normal full-load quantity. As operation of the engine continues, with a further increase in rpm, the starting lever 18 together with the adjusting lever 30 is now pivoted, depending upon the initial stressing of the governor spring arrangement 33, at the latest upon the attainment of the breakaway rpm, and the annular slide element 16 is thereby displaced still farther downward.

Figure 2:
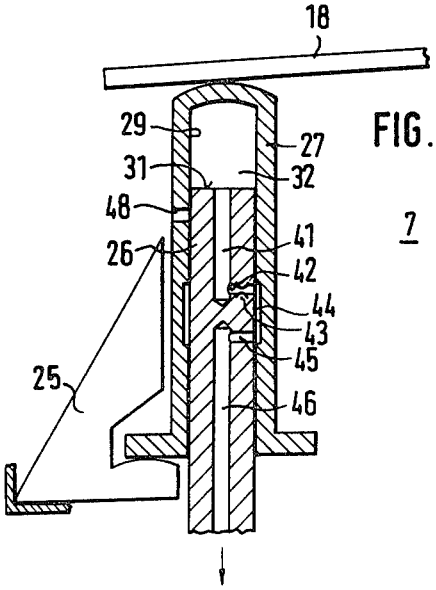
FIG. 2 shows a fragmentary first exemplary embodiment of the governor, embodied according to the invention, of a fuel injection pump in its outset position.

In the embodiment according to the invention, the governor sleeve 27 is guided tightly on the piston 26, is closed at one end and in its inner bore, together with the end face 31 of the piston 26, it encloses the pressure chamber 32 (FIG. 2). A connecting line 41 leads away from the end face 31, coaxially with the piston 26, and is embodied as a blind bore at the end of which a radial bore 42 leads away toward the jacket face of the sleeve. A throttle 43 is disposed in the radial bore 42. In the outset position shown in FIG. 2 for the governor sleeve 27, the radial bore 42 discharges into an annular groove 44, which is located on the jacket face of the inner bore 29.

A relief line 46 which is embodied as a blind bore also extends coaxially within the piston 26 and, as indicated in FIG. 1, leads to the intake side of the fuel supply pump 13 or to the fuel supply container 14. At the end of the relief bore 46 in the piston 26, a radial bore 45 branches off, likewise discharging into the annular groove 44 when the governor sleeve 27 is in the outset position. Means defining an opening 48 is provided in the jacket portion of the governor sleeve 27 in order to provide communication between the pressure chamber 32 and the surrounding suction chamber; in the illustrated outset position of the governor sleeve 27, this opening 48 is closed by the piston 26, and upon a displacement of the governor sleeve 27 after passing the end face 31, this means defining the opening 48 is consequently opened. From this point on, communication is established between the suction chamber 7 and the pressure chamber 32.

The apparatus according to the invention functions as follows:

In the outset position of the governor sleeve 27, the communication between the pressure chamber 32 and the suction chamber 7 is interrupted, as has been noted. The pressure chamber 32 is, however, relieved toward the fuel supply container 14 via the connecting line 41, the radical bore 42, the annular groove 44, the radial bore 45 and the relief line 46. Upon starting of the engine, corresponding to the outset position of the governor sleeve 27 shown in FIG. 2, the annular slide 16 assumes its uppermost position, so that the total quantity of fuel supplied by the pump piston 3 reaches the injection locations. With increasing rpm, the pressure in the suction chamber 7 increases as well, yet the pressure in the pressure chamber 32 does not change. Thus as the engine runs up to operating speed, both the force with which the starting spring presses onto the starting lever 18 and the differential pressure between the pressure in the pressure chamber 32 and the suction chamber 7 act upon the governor sleeve 27. The flyweights 25 must accordingly exert a force which has been increased by the product of the differential pressure and the surface area of the end face, in order to move the governor sleeve 27 out of the outset position in order to shut off the increased starting quantity. The shut-off of the increased starting quantity is thus effected at an rpm which is higher than that in the case of the known art. Once the governor sleeve 27 has been deflected to such an extent that the radial bore 45 is closed and the opening 48 has been opened by the end face 31 (FIG. 3), it is possible for a pressure equalization to take place in the pressure chamber 32, so that the centrifugal governor functions in the conventional, known manner. The forces exerted by the fuel pressure onto the governor sleeve 27 cancel one another out from this point on. As a result of the increased restoring force exerted on the governor sleeve in the starting position of the governor sleeve, the increased starting quantity is thus shut off only at a relatively high rpm, one which is already within the idling rpm range, while in contrast, when the rpm is dropping, the full idling regulation path of the governor sleeve can be exploited without causing the increased starting quantity to be supplied. Thus a hysteresis between the initiation and termination of the increased starting quantity is established. The full course of the hysteresis loop is only completed once the governor sleeve 27 has again assumed its outset position.

The hysteresis behavior can be influenced in terms of time by means of the throttle 43 provided in the radial bore 42.

Figure 4:
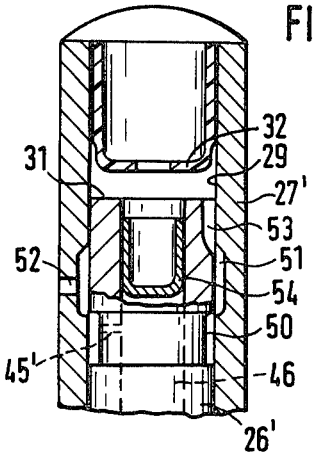
FIG. 4 shows another fragmentary view of a modified form of embodiment of the exemplary embodiment according to FIG. 2.
Figure 6:
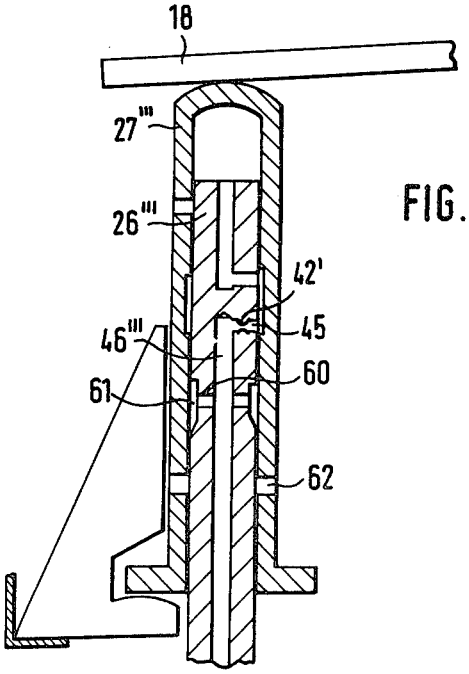
FIG. 6 shows still another fragmentary view of a fourth form of embodiment of the governor embodied according to the invention, having an additional discharge control location on the governor sleeve for influencing the pressure in the suction chamber of the fuel injection pump.

For the embodiment according to FIG. 2, there is a long series of equivalent solutions in terms of the functioning of such an apparatus. Naturally, the throttle 43 can be disposed in the radial bore 45 instead of in the radial bore 42 (FIG. 6). FIG. 4 shows an embodiment in which the relief conduit 46 discharges via a radial bore 45' into an annular groove 50 on the piston 26. The radical bore 45' may then be embodied as a throttle bore. In the illustrated outset position of the governor sleeve 27', the annular groove 50 communicates with an inner annular groove 51 in the jacket face of the inner bore 29 of the governor sleeve 27'. The inner annular groove 51 has a throttle connection to the pump suction chamber via an opening 52 in the jacket of the governor sleeve 27'. The inner annular groove 51 furthermore communicates, in the illustrated outset position of the governor sleeve 27', with a longitudinal groove 53 which begins at the end face 31 of the piston 26'.

In the exemplary embodiment according to FIG. 4, in the outset position of the governor sleeve 27', the fuel flows out of the suction chamber 7 via the opening 52, the inner annular groove 51, the annular groove 50, and the radial bore 45' to the relief line 46. The pressure chamber 32 also communicates with the relief line 46 via the longitudinal groove 53, so that the pressure in this pressure chamber 32 is reduced in comparison with that in the suction chamber 7. As soon as the rpm is high enough, that is, the centrifugal force acting upon the governor sleeve 27' is great enough, to overcome both the force of the starting spring and the force resulting from the differential pressure, the annular groove 50 is closed with the raising of the governor sleeve 27', and the pressure prevailing in the suction chamber 7 is delivered via the longitudinal groove 53 to the pressure chamber 32. From this breakaway point on, the governor operates in a normal fashion as already described for the foregoing exemplary embodiment.

The advantage in the embodiment according to FIG. 4 is that as a result of the throttling effect of the opening 52 in combination with the radial bore 45', a desired pressure can be established in the pressure chamber 32, and thus the additional hydraulic force acting upon the governor sleeve 27', can be determined. The hysteresis behavior of the governor is thus established as well. An advantageous embodiment of FIG. 4 provides that the relief bore is realized as a through longitudinal bore in the piston 26', and in order to close the relief bore 46, a closure capsule 54 is pressed in from the direction of the end face 31.

Figure 5:
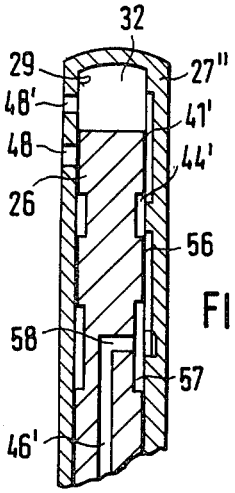
FIG. 5 shows another fragmentary view of a third form of embodiment of the governor embodied according to the invention.

A modification of the embodiment of FIG. 2 is shown in FIG. 5. Here, an annular groove 44' is provided on the piston 26'', corresponding in function to the annular groove 44 of FIG. 2. A longitudinal groove 41' is provided as a connecting conduit between the annular groove 44' and the pressure chamber 32. This longitudinal groove 41' is located in the jacket face of the inner bore 29 of the governor sleeve 27''. Thus, in the outset position of the governor sleeve, the longitudinal groove 41' connects the annular groove 44' with the pressure chamber 32. The relief conduit 46 of the embodiment of FIG. 2 is furthermore realized in FIG. 5 in part by a longitudinal groove 56, which is likewise disposed in the jacket face of the inner bore 29 of the governor sleeve 27'' and in the outset position of the governor sleeve communicates with the annular groove 44'. The longitudinal groove 56 is furthermore in continuous communication, that is, independently of the position of the governor sleeve, with a second annular groove 57 which is disposed in the jacket face of the piston 26'' and communicates via a radial bore 58 with the relief line 46'. One of the longitudinal grooves 41' or 56 may thereby be embodied as throttle restrictions. The pressure chamber 32 can also be made to communicate via an opening 48 in the governor sleeve 27'' with the surrounding suction chamber 7. The opening 48 may either be disposed, as in the exemplary embodiment of FIG. 2, such that in the outset position of the governor sleeve 27'' it is closed by the piston 26', or else the pressure chamber 32 may communicate continuously with the suction chamber 7 via an opening 48' disposed instead at a higher level. In this arrangement adapted to the embodiment of FIG. 4, the opening 48' must be embodied as a throttle opening, in order to establish a desired pressure which has been decreased relative to the suction chamber pressure.

In addition to these illustration embodiments, there are also further variant embodiments which need not be described in detail here. The annular groove may be disposed either in the piston as shown or in the inner sleeve wall, and both lines and grooves may be used as connecting elements between the sleeve and pressure chamber on the one hand and the sleeve and the relief line on the other. On the other hand, a longitudinal groove can also be used instead of an annular groove, and then corresponding annular grooves are provided in the sleeve and piston in order to reliably assure the control functions of the connection between the pressure chamber 32 and the relief line 46'. These annular grooves can then communicate in turn, via longitudinal grooves or bores, with the pressure chamber or the relief line.

Figure 3:
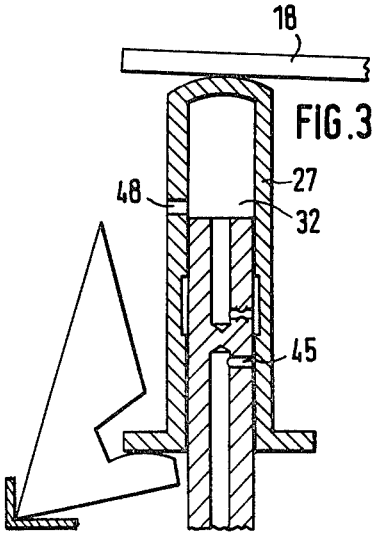
FIG. 3 shows another fragmentary view of the exemplary embodiment of FIG. 2 having a governor sleeve in the operating position.

In another advantageous construction of FIG. 6 there is shown an embodiment in which the relief line 46 according to the embodiment of FIG. 2, the relief line 46''' in FIG. 3, serves to receive fuel which flows out of the suction chamber in a controlled manner in order to influence the pressure in the suction chamber. To this end, a radial through bore 60 is provided in a manner known per se in the piston 26''', intersecting the relief line 46'''. In the area of the outlet of the radial throughbore 60, an annular groove 61 is provided on the piston 26''', cooperating with openings 62 in the jacket of the governor sleeve 27'''. Beyond a specific deflected position of the governor sleeve, the openings 62 come into communication with the annular groove 61, so that fuel can now flow out of the suction chamber into the relief line 46''', and the pressure in the suction chamber is lowered. In order to improve the transitional behavior, the annular groove 61 is embodied with a depth which decreases in the direction of the openings 62.

With this embodiment, an advantageous combination is attained, generating a starting hysteresis behavior on the part of the governor for controlling the increased starting quantity and providing load-dependent control of the pressure in the suction chamber 7.

The foregoing relates to preferred exemplary embodiments of the invention, it being understood that other embodiments and variants thereof are possible within the spirit and scope of the invention, the later being defined by the appended claims.

What is claimed and desired to be secured by Letters Patent of the United States is:

1. A fuel injection pump for internal combustion engines having a fuel supply pump generating an rpm-dependent pressure in a suction chamber of the fuel injection pump and an rpm governor provided with a governor sleeve, said sleeve being displaceable on a piston having end and jacket faces by means of an rpm-dependent force counter to the force of a governor spring arrangement which further comprises a starting spring, further wherein said governor sleeve actuates a fuel quantity adjusting device in such a manner that with an increasingly long adjustment path of said governor sleeve the fuel quantity is reduced, said governor sleeve further arranged to enclose in its interior a pressure chamber defined by said end face of said piston and said pressure chamber being connectable with said pump suction chamber which surrounds said governor sleeve, characterized in that said pressure chamber, in said governor sleeve has an outset position and at said outset position said pressure chamber communicates via a relief line with a chamber of lower pressure, and further that said relief line is closable beyond a predetermined stroke of said governor sleeve by means of a control edge.

2. A fuel injection pump as defined by claim 1, characterized in that said relief line is disposed in said piston and arranged to discharge into a recess disposed in said governor sleeve, said recess further including a limitation edge adapted to communicate with said pressure chamber, at least in the outset position of the governor sleeve, via a connecting line and further that said communication between said relief line and said connecting line can be interrupted by means of said axial limitation edge of said recess after a predetermined stroke of said governor sleeve has been executed.

3. A fuel injection pump as defined by claim 1, characterized in that said said relief line is disposed in said governor sleeve and arranged to discharge into a recess disposed in said piston, said recess further including a limitation edge adapted to communicate with said pressure chamber, at least in the outset position of the governor sleeve, via a connecting line and further that said communication between said relief line and said connecting line can be interrupted by means of said axial limitation edge of said recess after a predetermined stroke of said governor sleeve has been executed.

4. A fuel injection pump as defined by claim 2, characterized in that said relief line is disposed in the interior of said piston and further includes a radial outlet at said jacket face of said piston and further that said radial outlet, in the outset position of the governor sleeve, discharges into a recess in said jacket face of said governor sleeve and further that said recess has a control edge.

5. A fuel injection pump as defined by claim 4, characterized in that said communication between said recess and said pressure chamber can be established via a connecting line extending within said piston and exiting in the vicinity of said recess.

6. A fuel injection pump as defined by claim 4, characterized in that said connection between said recess and said pressure chamber is embodied as a groove in said jacket face of said piston.

7. A fuel injection pump as defined by claim 4 or 5, characterized in that said recess is an annular groove.

8. A fuel injection pump as defined by claim 2 or 3, characterized in that said relief line further includes a throttle.

9. A fuel injection pump as defined by claim 2 or 3 characterized in that a throttle is provided in said connecting line.

10. A fuel injection pump as defined by claim 7 or 8, characterized in that said connection between said pressure chamber and said pump suction chamber comprises means defining an opening in said governor sleeve in proximity to said control edge.

11. A fuel injection pump as defined by claim 10, characterized in that said means defining said opening comprises a throttle.

12. A fuel injection pump as defined by claim 2 or 3, characterized in that said connection between said pressure chamber and said pump suction chamber is embodied as means defining an opening in said governor sleeve, and in the outset position of said governor sleeve said opening is closed by said piston.

13. A fuel injection pump as defined by claim 4, characterized in that said relief line comprises an axial bore beginning at the end face of the piston, the connection of this axial bore with the pressure chamber being closed by a closure piece, and this axial bore having a radial bore on the relief side of the closure piece.

* * * * *